US009731532B2

(12) United States Patent
Katakura

(10) Patent No.: US 9,731,532 B2
(45) **Date of Patent: *Aug. 15, 2017**

(54) IMAGE DECOLORING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Hiroshi Katakura, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/241,263

(22) Filed: Aug. 19, 2016

(65) Prior Publication Data

US 2016/0355038 A1 Dec. 8, 2016

Related U.S. Application Data

(63) Continuation of application No. 14/612,384, filed on Feb. 3, 2015, now Pat. No. 9,452,628.

(51) Int. Cl.

| | |
|---|---|
| ***B41M 5/30*** | (2006.01) |
| ***B41M 7/00*** | (2006.01) |
| ***B41J 2/475*** | (2006.01) |

(52) U.S. Cl.

CPC ..... *B41M 5/305* (2013.01); *B41J 2/4753* (2013.01); *B41M 7/009* (2013.01); *B41M 7/0009* (2013.01)

(58) Field of Classification Search

CPC ..... B41M 5/305; B41M 7/009; B41M 7/0009
See application file for complete search history.

(56) References Cited

U.S. PATENT DOCUMENTS

| | | | | |
|---|---|---|---|---|
| 8,817,057 | B2 * | 8/2014 | Yamaguchi | B41J 29/36 347/179 |
| 8,879,976 | B2 | 11/2014 | Fujiwara et al. | |
| 8,885,004 | B2 | 11/2014 | Iguchi | |
| 9,452,628 | B2 * | 9/2016 | Katakura | B41M 5/305 |
| 2012/0082484 | A1 | 4/2012 | Shimmura et al. | |
| 2013/0002782 | A1 * | 1/2013 | Kawaguchi | G03G 15/6585 347/179 |

(Continued)

OTHER PUBLICATIONS

Non-Final Office Action for U.S. Appl. No. 14/612,384 mailed on Feb. 19, 2016.

*Primary Examiner* — Julian Huffman
*Assistant Examiner* — Michael Konczal
(74) *Attorney, Agent, or Firm* — Amin, Turocy & Watson LLP; Gregory Turocy

(57) ABSTRACT

In accordance with an embodiment, an image decoloring apparatus comprises a conveyance path configured to convey a sheet on which an image is formed with a coloring agent that is decolored by heat; a first heat roller configured to be arranged at the upstream side of the conveyance path; and a second heat roller configured to be arranged at the downstream side of the conveyance path. Each of the first heat roller and the second heat roller includes a cylindrical portion and a heat source. The thickness of the cylindrical portion constituting the first heat roller is larger than the thickness of the cylindrical portion constituting the second heat roller. In this way, the heat capacity of the first heat roller is also larger than the heat capacity of the second heat roller.

5 Claims, 6 Drawing Sheets

(56) References Cited

U.S. PATENT DOCUMENTS

| | | | | |
|---|---|---|---|---|
| 2014/0153951 | A1* | 6/2014 | Shimmura | G03G 15/6585 399/69 |
| 2014/0169819 | A1 | 6/2014 | Katakura | |
| 2014/0213444 | A1* | 7/2014 | Takada | F27B 9/40 503/201 |
| 2014/0320580 | A1 | 10/2014 | Kawaguchi | |

* cited by examiner

IMAGE DECOLORING APPARATUS

CROSS-REFERENCE TO RELATED APPLICATIONS

This application is a Continuation of application Ser. No. 14/612,384 filed on Feb. 3, 2015, the entire contents of which are incorporated herein by reference.

FIELD

Embodiments described herein relate generally to an image decoloring apparatus.

BACKGROUND

An image decoloring apparatus which decolors an image formed on a sheet by an image forming apparatus such as a MFP (Multi-function Peripheral) and the like has been used. The image serving as a decoloring target is formed using a coloring agent having decoloring characteristic such as ink containing leuco dye and the like.

The coloring agent having decoloring characteristic has a property that decolors the color thereof by applying a high temperature thereto. Thus, the image decoloring apparatus can heat the sheet to decolor the image formed on the sheet. An example of such an image decoloring apparatus is disclosed in Japanese Unexamined Patent Application Publication No. Hei 10-161492, U.S. Pat. RE37197 and the like.

When conveying a sheet nipped by a heat roller and a press roller, the image decoloring apparatus heats the sheet to decolor the color of the coloring agent. Decoloring sections each of which consists of a heat roller and a press roller are arranged at the upstream side and the downstream side of a conveyance path of the sheet, and are constituted in such a manner that images on the two surfaces of the sheet can be decolored.

The sheet conveyed by the image decoloring apparatus is heated by a decoloring section at the upstream side and then conveyed to a decoloring section at the downstream side. As a result, compared with the decoloring section at the upstream side, it is not required for the decoloring section at the downstream side to apply that much heat to the sheet. Thus, in a case in which the heat rollers that are respectively arranged at the upstream side and the downstream side have the same heat capacity, the decoloring section at the downstream side is provided with an unnecessarily large-sized constitution, which leads to increase in power consumption.

DETAILED DESCRIPTION

Figure 1:
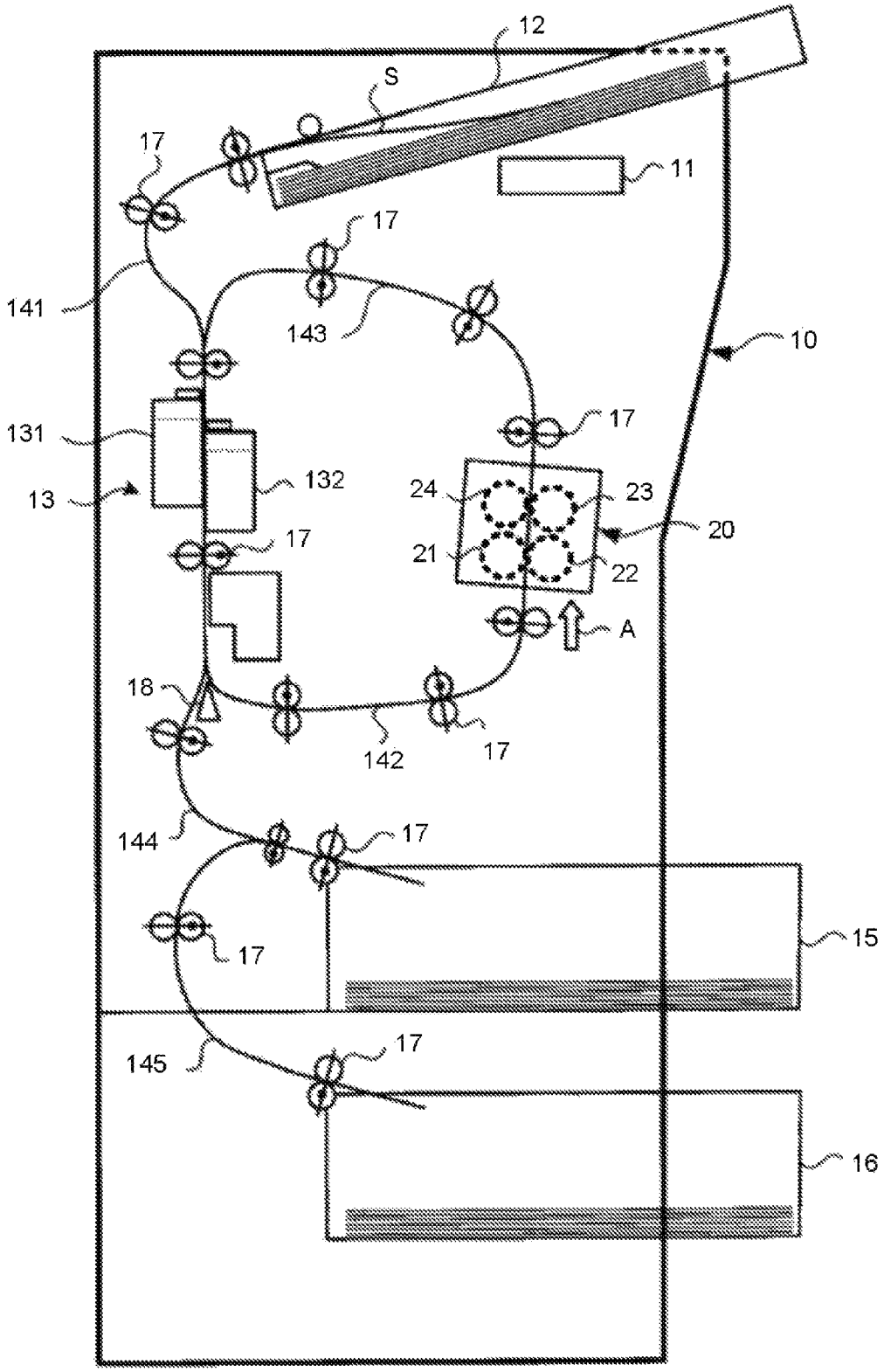
FIG. 1 is a schematic side view illustrating an image decoloring apparatus according to an embodiment.

In accordance with one embodiment, an image decoloring apparatus comprises a conveyance path configured to convey a sheet on which an image is formed with a coloring agent that is decolored by heat; a first decoloring section configured to convey and heat the sheet nipped between a first heat roller and a first press roller which are arranged opposite to each other across the conveyance path; and a second decoloring section configured to be arranged at the downstream side of the first decoloring section on the conveyance path to include a second heat roller and a second press roller, which are arranged opposite to each other across the conveyance path and respectively reversed with respect to the first heat roller and the first press roller, wherein the thickness of the second heat roller is smaller than the thickness of the first heat roller.

Hereinafter, one embodiment of the present invention is described with reference to the accompanying drawings. Further, same components are indicated by the same reference numerals in the drawings, and repetitive description is not provided.

As shown in FIG. 1, an image decoloring apparatus 10 according to the embodiment comprises an operation panel 11 including a display section and operation buttons, a sheet feed section 12, a scanner 13 and a decoloring section 20.

The image decoloring apparatus 10 further comprises a first conveyance path 141, a second conveyance path 142, a third conveyance path 143, a fourth conveyance path 144, a fifth conveyance path 145, a first sheet discharge tray 15 and a second sheet discharge tray (reject box) 16.

Each of the conveyance paths 141~145 is provided with a plurality of conveyance rollers 17 for conveying a sheet. A bifurcating section 18 is arranged to distribute the conveyance of the sheet to either the second conveyance path 142 or the fourth conveyance path 144.

The operation panel 11 which comprises an input device such as a plurality of operation buttons, a touch panel and the like inputs various instructions and information to the image decoloring apparatus 10.

The sheet feed section 12 is supplied with a sheet S serving as a target on which an image is to be decolored. The sheet feed section 12 picks up the sheet S one by one to feed it to the first conveyance path 141. The sheet S is, for example, a paper.

The scanner 13 includes a first scan section 131 which scans an image formed on the surface of the sheet S conveyed on the first conveyance path 141, and a second scan section 132 which scans an image formed on the back surface of the sheet S. The scanner 13 supplies the image data of the images read by the first scan section 131 and the second scan section 132 to a control section 100 that is described later with reference to FIG. 4.

Figure 2:
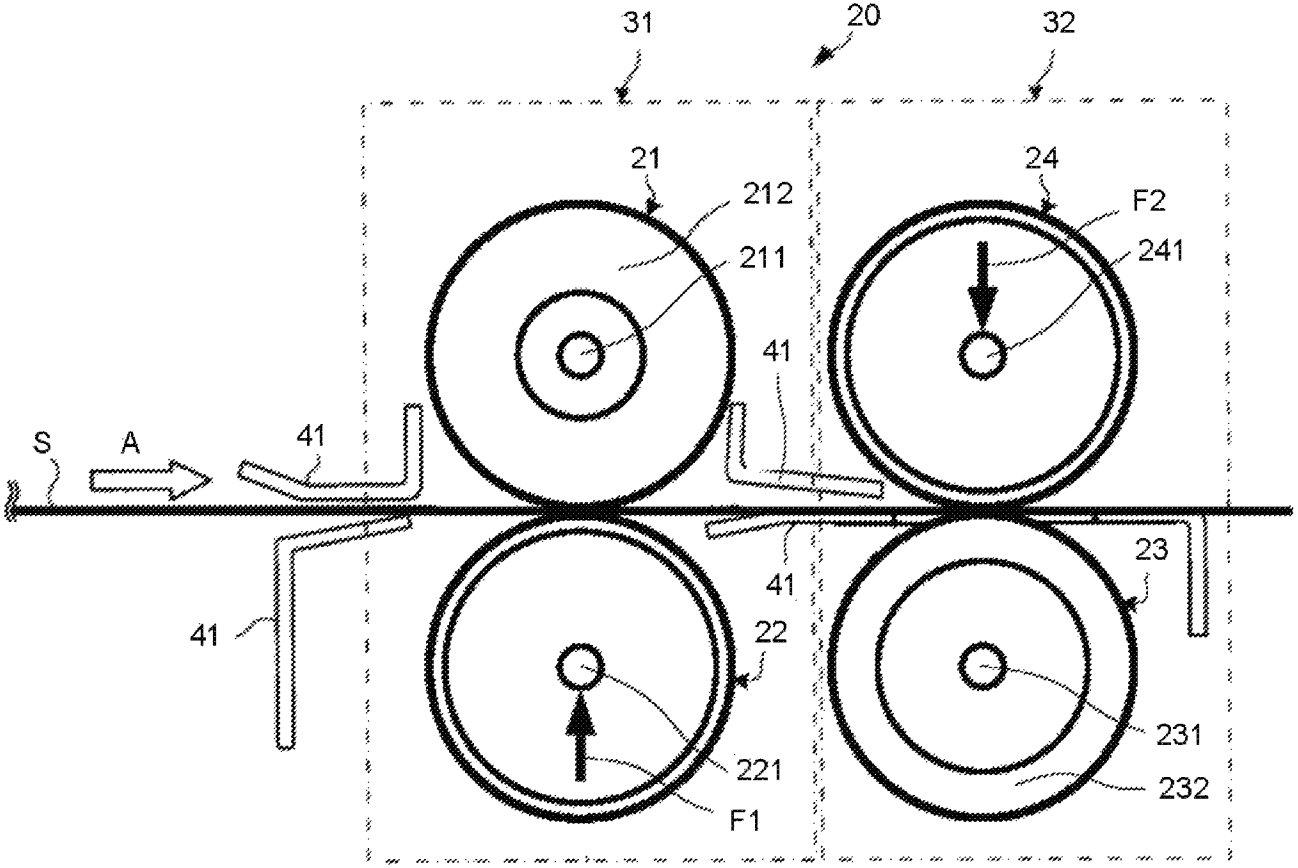
FIG. 2 is a side view illustrating the constitution of a decoloring section of the image decoloring apparatus shown in FIG. 1.

The decoloring section 20 applies heat to the sheet S to decolor the image formed on the sheet S. As shown in FIG. 2, the decoloring section 20 includes a pair of rollers (a heat roller 21 and a press roller 22) arranged at the upstream side of the conveyance path, and a pair of rollers (a heat roller 23 and a press roller 24) arranged at the downstream side of the conveyance path. The heat roller 21 heats one surface of the sheet S and the heat roller 23 heats the other surface of the sheet S. The description of the decoloring section 20 is described later.

The first conveyance path 141 conveys the sheet S from the sheet feed section 12 to the scanner 13. The second conveyance path 142 conveys the sheet S from the scanner 13 to the decoloring section 20 as indicated by an arrow A. The third conveyance path 143 conveys the sheet S from the decoloring section 20 to the scanner 13. The fourth conveyance path 144 conveys the sheet S from the scanner 13 to the first sheet discharge tray 15. The fifth conveyance path 145 conveys the sheet S from the scanner 13 to the second sheet discharge tray (reject box) 16.

The first sheet discharge tray 15 collects the sheet S which can be reused as the image on which is decolored. The second sheet discharge tray (reject box) 16 collects the sheet S which is difficult to be reused and scrapped to be recycled.

The plurality of conveyance rollers 17 which is arranged on the conveyance paths rotates to convey the sheet S.

The bifurcating section 18 switches the conveyance destination of the sheet S that is conveyed on the first conveyance path 141 between the second conveyance path 142 and the fourth conveyance path 144.

Next, the detailed constitution of the decoloring section 20 is described with reference to FIG. 2 and FIG. 3.

As shown in FIG. 2, the decoloring section 20 includes a first decoloring section 31 arranged at the upstream side of the conveyance path, a second decoloring section 32 arranged at the downstream side of the conveyance path, and a plurality of guide plates 41 for guiding the sheet S.

The first decoloring section 31 includes a pair of rollers (the heat roller 21 and the press roller 22). The second decoloring section 32 includes a pair of rollers (the heat roller 23 and the press roller 24). The sheet S, which is sequentially nipped by the heat roller 21 and the press roller 22, and by the heat roller 23 and the press roller 24, is conveyed and heated. Each of the heat rollers 21 and 23 includes a heat source inside and a temperature detection section on the peripheral surface thereof. A lamp such as a halogen lamp is used as the heat source.

The heat roller 21 and the press roller 22 are opposite to each other across the second conveyance path 142, and a line connecting the central axes of the heat roller 21 and the press roller 22 is located at a position orthogonal to the conveyance direction of the sheet S. An axis 221 of the press roller 22 is energized by a spring and the like towards a direction (indicated by an arrow F1) of the heat roller 21 so that the heat roller 21 is contacted with a first surface of the sheet S.

The heat roller 23 and the press roller 24 are arranged opposite to each other across the second conveyance path 142 and reversed with respect to the heat roller 21 and the press roller 22 of the first decoloring section 31. That is, the heat roller 21 of the first decoloring section 31 is positioned at the first side (for example, the front side) of the sheet S, and the heat roller 23 of the second decoloring section 32 is positioned at the second side (for example, the back side) of the sheet S.

The diameter of the heat roller 23 is equal to that of the press roller 24, the heat roller 21 and the press roller 22, respectively. The heat roller 23 and the press roller 24 are arranged in such a manner that a line connecting the central axes of the heat roller 23 and the press roller 24 is orthogonal to the conveyance direction of the sheet S. An axis 241 of the press roller 24 is energized by a spring and the like towards a direction (indicated by an arrow F2) of the heat roller 23.

In a state in which there is no sheet S, the heat roller 21 is contacted with the press roller 22, and the heat roller 23 is contacted with the press roller 24.

Figure 3:
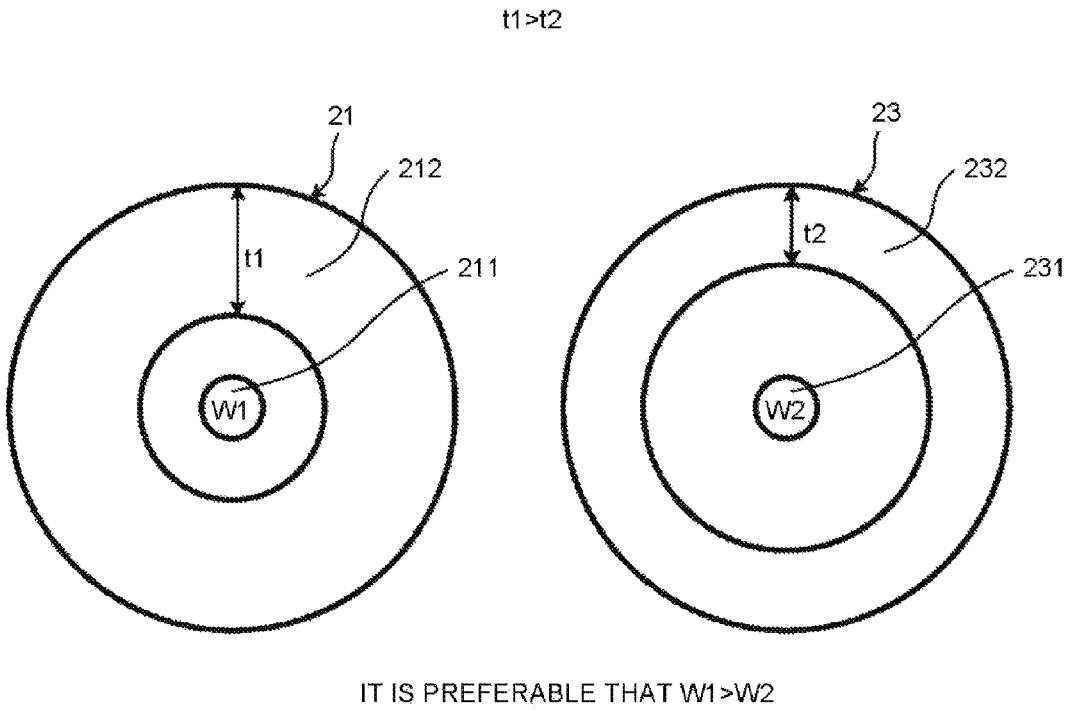
FIG. 3 is a side view illustrating the constitutions of two heat rollers.

The heat rollers 21 and 23, which are shown in parallel to each other in FIG. 3, respectively consist of aluminum cylindrical portions 212 and 232 that are coated by fluorine on the surfaces thereof, and respectively comprise a heat source 211 and a heat source 231 such as a halogen lamp inside.

A thickness t1 of the cylindrical portion 212 of the heat roller 21 at the upstream side is larger than a thickness t2 of the cylindrical portion 232 of the heat roller 23 at the downstream side. That is, t1>t2. Thus, the heat capacity of the heat roller 21 is greater than the heat capacity of the heat roller 23.

Figure 4:
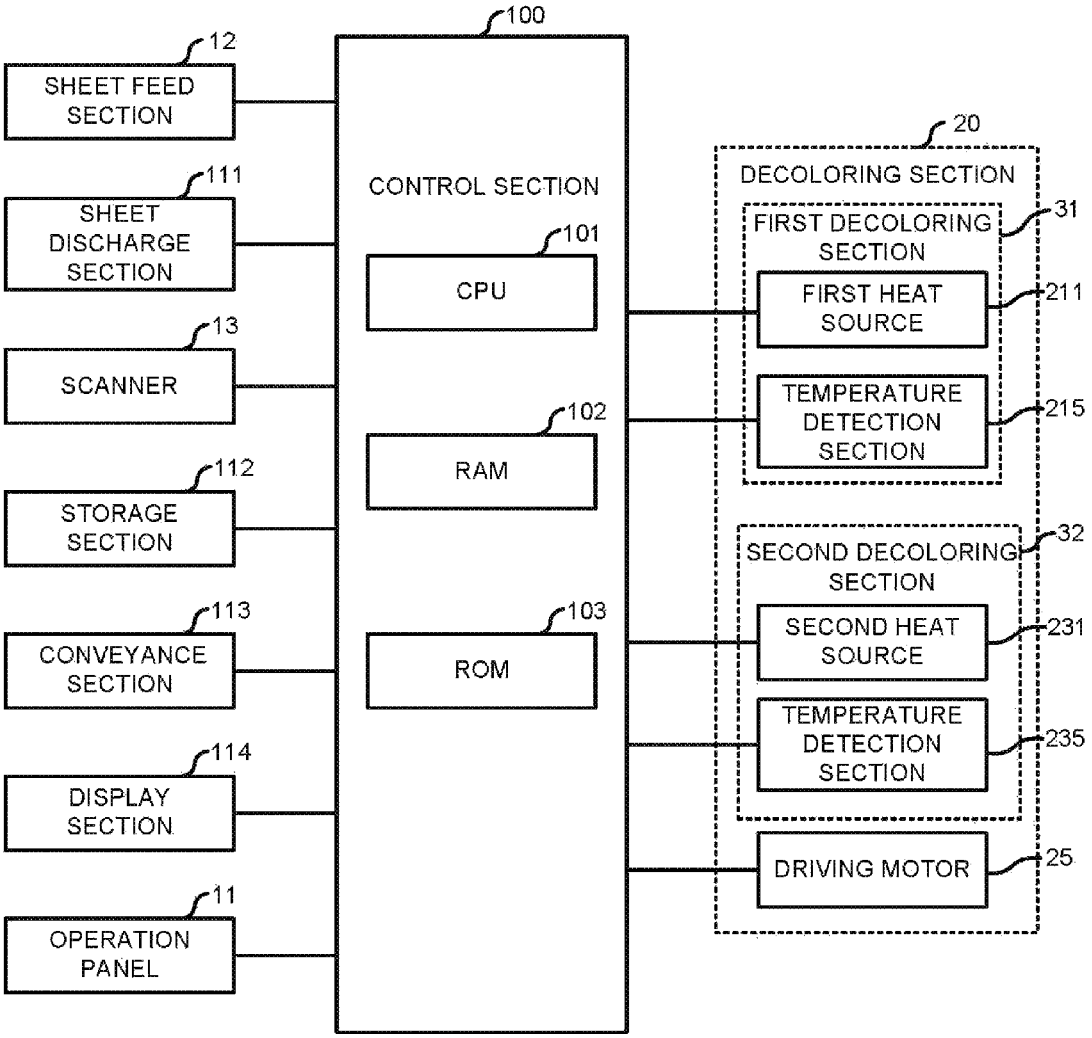
FIG. 4 is a block diagram illustrating a control system of the image decoloring apparatus shown in FIG. 1.

The heat roller 21 is rotated anticlockwise and the heat roller 23 is rotated clockwise through a driving motor 25 that is described later with reference to FIG. 4, in this way, the heat rollers 21 and 23 are rotated to a direction in which the sheet S is conveyed. The press roller 22 and the press roller 24 are also driven to rotate through the rotation of the heat rollers 21 and 23.

Further, the plurality of guide plates 41 is arranged to guide the sheet S to the first decoloring section 31 and the second decoloring section 32. The guide plates 41 constitute a part of the second conveyance path 142.

In the constitution in FIG. 2, the sheet S passes through between the heat roller 21 and the press roller 22, and then between the heat roller 23 and the press roller 24. As a result, the image on the first surface thereof is decolored by the first decoloring section 31. At this time, since heat is also transmitted to the second surface of the sheet S, part of the image on the second surface is also decolored. The image that is not decolored and left on the second surface of the sheet S is decolored by the second decoloring section 32.

That is, the second surface of the sheet S is preheated by the first decoloring section 31, and thus the image on the second surface of the sheet S can be completely decolored even if the thickness t2 of the cylindrical portion 232 of the heat roller 23 of the second decoloring section 32 is set to be thin and the heat capacity of the heat roller 23 is reduced.

In this case, if the first heat source 211 and the second heat source 231 have the same heat capacity (calorific value per unit time), even if the first heat source 211 and the second heat source 231 start to generate heat at a same timing, the second heat roller 23 completes the temperature increase first, and then becomes to be a state of waiting the completion of the temperature increase of the first heat roller 21. For this reason, it can be aware that the efficiency is bad if taking the power consumption and the flicker into account. Thus, in order to complete the temperature increase of the first heat source 211 and the temperature increase of the second heat source 231 almost at the same time, it is preferred to set the heat capacity W1 (calorific value J/S) of the heat source 211 of the first heat roller 21 to be larger than the heat capacity W2 (calorific value J/S) of the heat source 231 of the second heat roller 23.

Next, the constitution of the control system of the image decoloring apparatus 10 is described with reference to FIG. 4. The image decoloring apparatus 10 comprises the control section 100. The control section 100 includes, for example, a processor (CPU) 101, a random access memory (RAM) 102, a read only memory (ROM) 103 and the like.

The processor 101 executes control programs stored in the ROM 103 to control the whole operations of the image decoloring apparatus 10. The RAM 102 is a main memory functioning as a work memory. The ROM 103 stores control programs which take charge of the operation of the image decoloring apparatus 10, control data and the like.

Specifically, the control section 100 controls the operation panel 11, the sheet feed section 12 and the scanner 13 based on the instruction from the operation panel 11. The control section 100 further controls the bifurcating section 18, the fourth conveyance path 144, the fifth conveyance path 145, and a sheet discharge section 111 including the first sheet discharge tray 15 and the second sheet discharge tray (reject box) 16 and the like. The control section 100 receives the read image data from the scanner 13 and stores it in a storage section 112, and meanwhile carries out a processing of evaluating the quality of the sheet S and the like.

The control section 100 controls a conveyance section 113 including the conveyance roller 17 and the bifurcating section 18 to control the conveyance of the sheet S on the first~fifth conveyance paths 141~145. Further, the control section 100 controls the bifurcating section 18 to convey the sheet S to the selected conveyance path, and then controls to discharge the decolored sheet to the first sheet discharge tray 15 and discharge the sheet which is not decolored or on which a rip or a crumple is generated to the second sheet discharge tray 16.

The control section 100 controls the first heat source 211 of the heat roller 21 and the second heat source 231 of the heat roller 23. Further, the control section 100 controls the temperature of the heat roller 21 and the temperature of the heat roller 23 in response to the temperature detection results from temperature detection sections 215 and 235 such as thermistor respectively arranged at the heat roller 21 and the heat roller 23. The control section 100 further controls the driving motor 25 which drives the heat rollers 21 and 23 to rotate.

Herein, as stated above, the heat capacity of the heat roller 21 is larger than the heat capacity of the heat roller 23. However, if the heat capacity of the first heat source 211 is set to be larger than the heat capacity of the second heat source 231, even if the control section 100 controls to start the heating of the heat source 211 and the heating of the heat source 231 almost at the same time, it is also possible to complete the heating of the heat roller 21 and the heating of the heat roller 23 almost at the same time.

Figure 5:
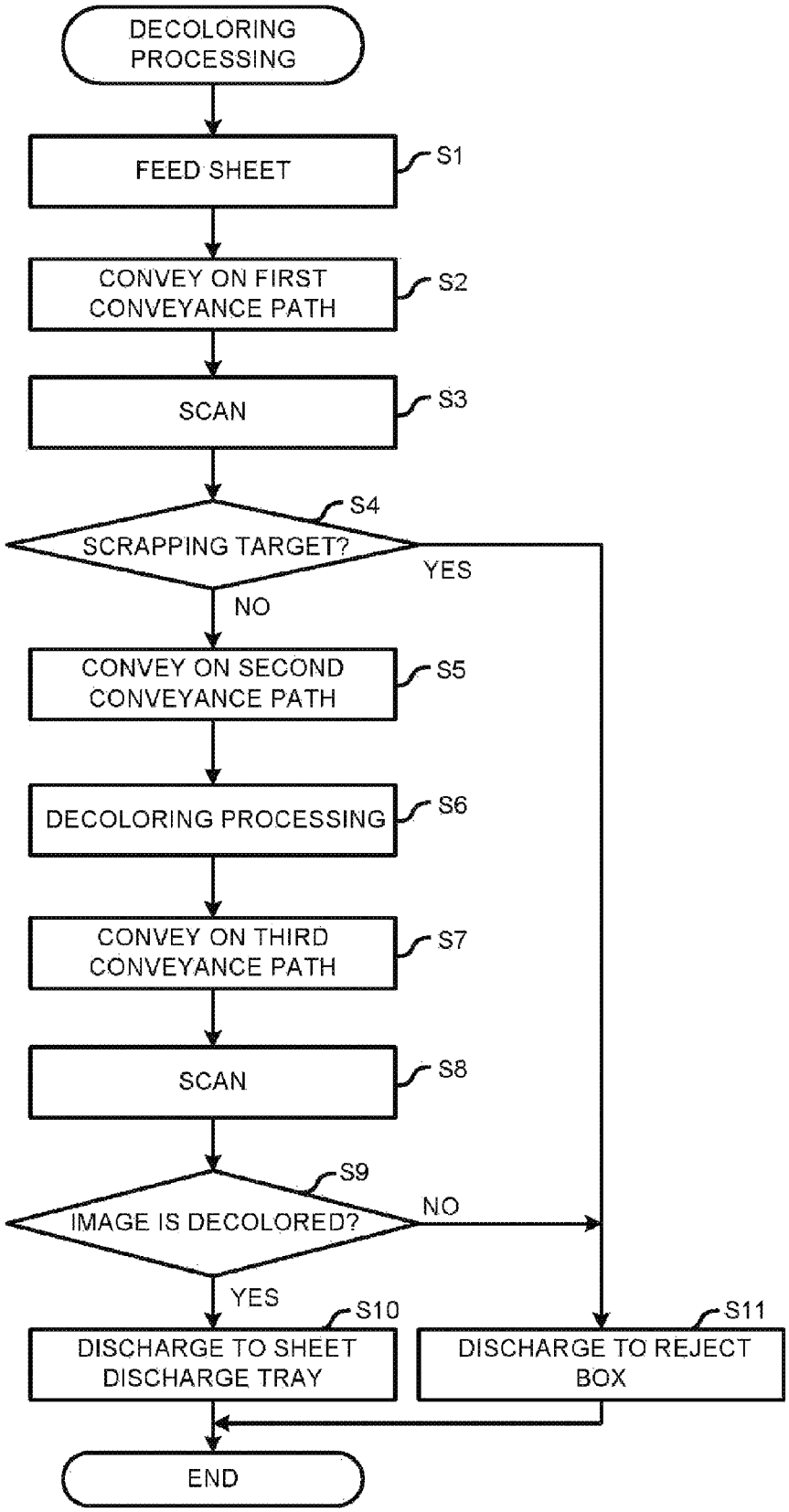
FIG. 5 is a flowchart illustrating a decoloring processing of the image decoloring apparatus shown in FIG. 1.

Next, the operation of the image decoloring apparatus 10 having the constitution described above is described with reference to the flowchart in FIG. 5. The following operation is executed under the control of the control section 100, and for facilitating understanding, the detailed description of the control section 100 is omitted.

First, in a case where an operation mode in which the decoloring and reading of the sheet S are carried out is selected through the operation panel 11, one sheet S is fed from the sheet feed section 12 to the first conveyance path 141 (ACT S1). The first conveyance path 141 conveys the sheet S to the scanner 13 (ACT S2). The scanner 13 scans an image on the sheet S to read the image on the sheet S (ACT S3). The image data read by the scanner 13 is supplied to the control section 100. The control section 100 stores the received image data in the storage section 112.

The control section 100 determines, according to the image data read by the scanner 13, whether or not there is a rip or a crumple on the sheet S, that is, whether or not the sheet S is a scrapping target (ACT S4). If determining that it is the scrapping target (there is a rip or a crumple) (YES in ACT S4), the control section 100 controls the conveyance section 113 to convey the sheet S to the second sheet discharge tray (reject box) 16 through the fifth conveyance path 145 (ACT S11).

Further, the control section 100 calculates a printing ratio (area of the part where ink is attached/area of the whole sheet) of the sheet S according to the image data read by the scanner 13 to determine whether or not the printing ratio is above a reference value (ACT S4). The sheet S having a high printing ratio is likely to curl during the decoloring process. Thus, the control section 100 regards the sheet S having a printing ratio higher than the reference value as a scrapping target (YES in ACT S4), and controls the conveyance section 113 to convey such a sheet S to the second sheet discharge tray (reject box) 16 (ACT S11).

If determining that there is no rip or crumple on the sheet S, that is, the sheet S is not a scrapping target according to the image data read by the scanner 13 (NO in ACT S4), the control section 100 controls to convey the sheet S to the decoloring section 20 through the second conveyance path 142 (ACT S5). The decoloring section 20 heats the heat rollers 21 and 23 to a relative high temperature, for example, 180~200 degrees centigrade to press and heat the sheet S (ACT S6).

In such a state, the decoloring section 20 first presses and heats the sheet S nipped between the heat roller 21 and the press roller 22 (ACT S6). Then, the decoloring section 20 presses and heats the sheet S that is heated by the heat roller 21 and nipped between the heat roller 23 and the press roller 24 (ACT S6). As the image on the sheet S is formed with a color material that can be decolored by heat, the image can be decolored.

The sheet S passing through the decoloring section 20 is conveyed to the scanner 13 through the third conveyance path 143 (ACT S7).

The scanner 13 reads the image on the sheet S again (ACT S8). The control section 100 determines, according to the image data read by the scanner 13, that there is no rip or crumple on the sheet S and whether or not the image on the sheet S is decolored (ACT S9).

If determining that there is no rip or crumple on the sheet S and the image is decolored (YES in ACT S9), the control section 100 conveys the sheet S to the first sheet discharge tray 15 through the fourth conveyance path 144 (ACT S10). The sheets stacked in the first sheet discharge tray 15 can be reused.

If determining that there is a rip or a crumple on the sheet S, or the image is left according to the image data read by the scanner 13 (NO in ACT S9), the control section 100 conveys the sheet S to the reject box 16 through the fifth conveyance path 145 (ACT S11). The sheets stacked in the reject box 16 are scrapped. In this way, the decoloring processing carried out for one sheet S is ended.

In the operations described above, the heat roller 23 at the downstream side further heats the sheet S heated by the heat roller 21 at the upstream side. Thus, as to the heat roller 23, the heat thereof absorbed by the sheet S is relatively small, and therefore the temperature fluctuation thereof when the sheet S is passing through the heat roller 23 is relatively small. On the contrary, as the heat roller 21 at the upstream side heats the unheated sheet S, the heat of the heat roller 21 absorbed by the sheet S is relatively large, and therefore the temperature fluctuation of the heat roller 21 when the sheet S is passing through the heat roller 21 is relatively large.

In the present embodiment, the thickness t1 of the cylindrical portion 212 of the heat roller 21 is set to be relatively large. Thus, the heat capacity of the heat roller 21 is large, and in this way, the temperature fluctuation can be suppressed. On the other hand, the thickness t2 of the cylindrical portion 232 of the heat roller 23 at the downstream side is set to be smaller than the thickness t1 of the cylindrical portion 212 of the heat roller 21. Thus, the heat capacity of the decoloring section 32 at the downstream side can be set to be smaller than the heat capacity of the decoloring section 31 at the upstream side, which can reduce the power consumption during the heating process.

Figure 6:
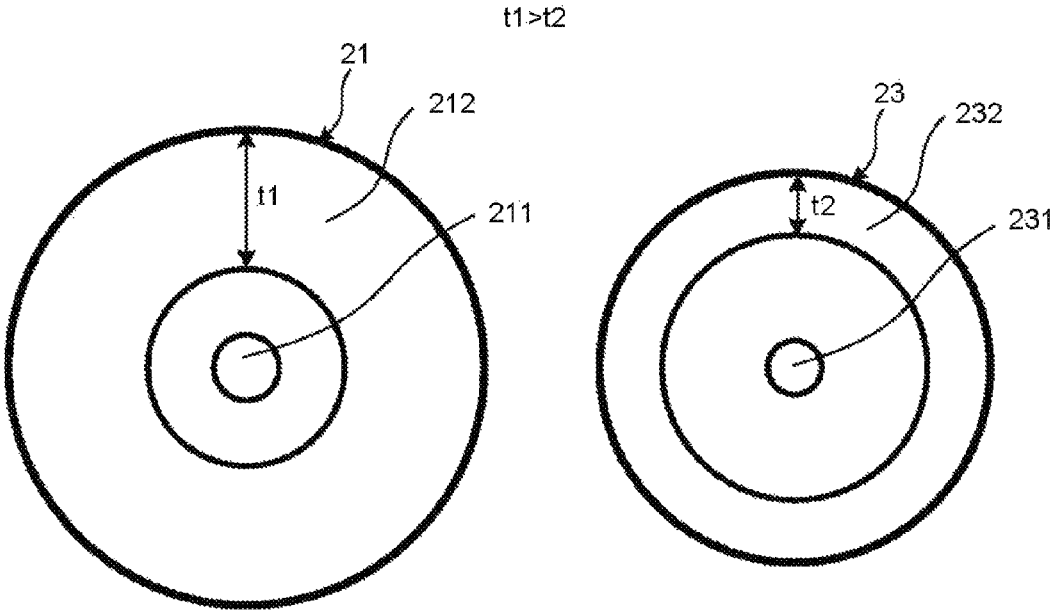
FIG. 6 is a side view illustrating a modification of the constitutions of the two heat rollers.

Further, in the first embodiment, the outer diameter of the heat roller 21 is set to be the same as that of the heat roller 23. However, it is not limited to this. As shown in FIG. 6, as long as the thickness t2 of the cylindrical portion 232 of the heat roller 23 is set to be smaller than the thickness t1 of the cylindrical portion 212 of the heat roller 21, the outer diameter of the heat roller 23 may be set to be smaller than the outer diameter of the heat roller 21.

The outer diameter of the press roller 22 and the outer diameter of the press roller 24 may also be properly changed. For example, the press roller 24 may have a smaller outer diameter than that of the press roller 22.

Further, the interval between the first decoloring section 31 and the second decoloring section 32 may be a distance capable of nipping the sheet S having the shortest length by the heat roller 21 and the press roller 22 and by the heat roller 23 and the press roller 24 simultaneously.

The hardness of the heat roller 21 (23) and the hardness of the press roller 22 (24) are different from each other. The hardness of the heat roller 21 (23) is set to be higher than that of the press roller 22 (24). The material of the heat rollers 21 and 23 may be changed.

It may also be integrally formed by incorporating the image decoloring apparatus of the present embodiment into the image forming apparatus.

It is exemplified in the embodiments described above that the image decoloring apparatus 10 comprises the scanner 13. However, the present invention may also be applicable to an image decoloring apparatus provided with no scanner.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image decoloring apparatus, comprising:

a conveyance path configured to convey a sheet on which an image is formed with a coloring agent that is decolored by heat;

a first decoloring section configured to convey and heat the sheet nipped between a first heat roller and a first press roller which are arranged opposite to each other across the conveyance path; and a second decoloring section configured to be arranged at the downstream side of the first decoloring section on the conveyance path to include a second heat roller and a second press roller, which are arranged opposite to each other across the conveyance path and respectively reversed with respect to the first heat roller and the first press roller, wherein a diameter of the first heat roller and another diameter of the second heat roller are substantially equal, and a heat capacity of the first heat roller and another heat capacity of the second heat roller are different heat capacities.

2. The image decoloring apparatus according to claim 1, wherein a heat capacity of the second decoloring section is smaller than a heat capacity of the first decoloring section.

3. The image decoloring apparatus according to claim 2, wherein the heat capacity W1 of the first heat source is larger than the heat capacity W2 of the second heat source.

4. The image decoloring apparatus according to claim 1 wherein hardness of the heat rollers are set to be higher than that of the press rollers.

5. The image decoloring apparatus according to claim 1, further comprising:

a sheet feed section configured to feed a sheet on which an image is formed with a coloring agent that is decolored by heat;

a reading section configured to read the image formed on the sheet;

a first conveyance path configured to convey the sheet from the sheet feed section to the reading section;

a second conveyance path configured to convey the sheet the image on which is read by the reading section to the first decoloring section;

a third conveyance path configured to convey the sheet passing through the first decoloring section and the second decoloring section to the reading section; and a sheet discharge section configured to determine, according to the result read by the reading section, whether the sheet is a reusable sheet or a reject sheet and then discharge it.

* * * * *